United States Patent [19]

Spicer

[11] 4,382,849

[45] May 10, 1983

[54] APPARATUS FOR ELECTROLYSIS USING GAS AND ELECTROLYTE CHANNELING TO REDUCE SHUNT CURRENTS

[76] Inventor: Laurence E. Spicer, R.R. #2, Box 262, Lineville, Iowa 50147

[21] Appl. No.: 215,182

[22] Filed: Dec. 11, 1980

[51] Int. Cl.[3] ..... C25B 9/00; C25B 11/04; C25B 13/02; C25B 15/08

[52] U.S. Cl. ..... 204/258; 204/266; 204/270; 204/292; 204/295

[58] Field of Search ..... 204/258, 270, 279, 295-296, 204/253-257, 267-269, 292, 228

[56] References Cited

U.S. PATENT DOCUMENTS

| | | | |
|---|---|---|---|
| 4,124,478 | 11/1978 | Tsien et al. | 204/279 X |
| 4,207,165 | 6/1980 | Mose et al. | 204/279 X |
| 4,210,511 | 7/1980 | Campbell et al. | 204/258 X |
| 4,253,932 | 3/1981 | Mose et al. | 204/253 |
| 4,256,562 | 3/1981 | Mose et al. | 204/270 X |
| 4,274,939 | 6/1981 | Bjäreklint | 204/279 X |
| 4,305,806 | 12/1981 | Holca | 204/270 X |
| 4,308,122 | 12/1981 | Das Gupta et al. | 204/228 X |
| 4,339,324 | 7/1982 | Haas | 204/269 X |

*Primary Examiner*—Donald R. Valentine
*Attorney, Agent, or Firm*—James Birkenholz

[57] ABSTRACT

An electrolyzer for the generation of hydrogen gas having parallel electrodes comprising a single cell with multiple cells connected in a series arrangement and a common electrolyte passing there through. The electrolyzer utilizes both sides of the electrodes except for the end electrode with a micro-porous separator isolating each pair of electrodes. The electrolyte passes from cell to cell through electrolyte and gas channeling and between the cells which effectively reduces electrical short circuiting within the electrolyzer.

The electrolyte and gas channeling carries the electrolyte to and from each cell to effectively reduce shunt currents between the cells and prevent short circuiting of the electrolyzer while still utilizing a common electrolyte and cooling the electrolyte.

14 Claims, 13 Drawing Figures

APPARATUS FOR ELECTROLYSIS USING GAS AND ELECTROLYTE CHANNELING TO REDUCE SHUNT CURRENTS

BACKGROUND OF INVENTION

1. Field of the Invention

The present invention relates to electrolytic cells for the generation of gas and particularly to an improved electrolytic cell wherein gas and electrolyte channeling is utilized to reduce shunt currents between cells and having an electrode arrangement permitting a majority of both sides of the electrode to be used.

2. Description of the Prior Art

The electrolysis process is frequently employed in devices for the generation of gasses by a decomposition process wherein multiple electrodes are immersed in an electrically conductive electrolyte with an electrical charge running between the electrodes. The volume of gas produced is in part dependent upon the exposed surface area of the electrodes to the electrolyte. In order to generate large volumes of gas, electrodes large physical dimensions or a large number of electrodes must be used, thus greatly increasing the physical dimensions of the electrolyzer.

Isolation of shunt currents between the individual cells within the electrolyzer is also a problem. One method frequently employed utilizes a metal plate for isolation, however, this approach further limits the useable surface area of the electrodes and in some cases limits electrode surface area to only one side of each electrode. Further the weight of the electrolyzer would be significantly increased, which is an undesireable result.

SUMMARY OF THE INVENTION

An electrolyzer wherein multiple electrodes are arranged and electrically connected parallel to each other to form a cell. Multiple cells are series connected with a common electrolyte circulated between the cells. The electrolyte from each cell passes through narrow electrolyte channeling and gas channeling with the gas channeling funneling the gas from each electrode to a common collective point. The electrolyte and gas channeling reduces shunt-currents within the electrolizer to a negligible level thereby preventing electrical short circuiting between cells. Both sides of the electrodes are incontact with the electrolyte except for the end electrodes, thereby increasing the surface area of the electrodes.

DESCRIPTION OF THE PREFERRED EMBODIMENT

Figure 1:
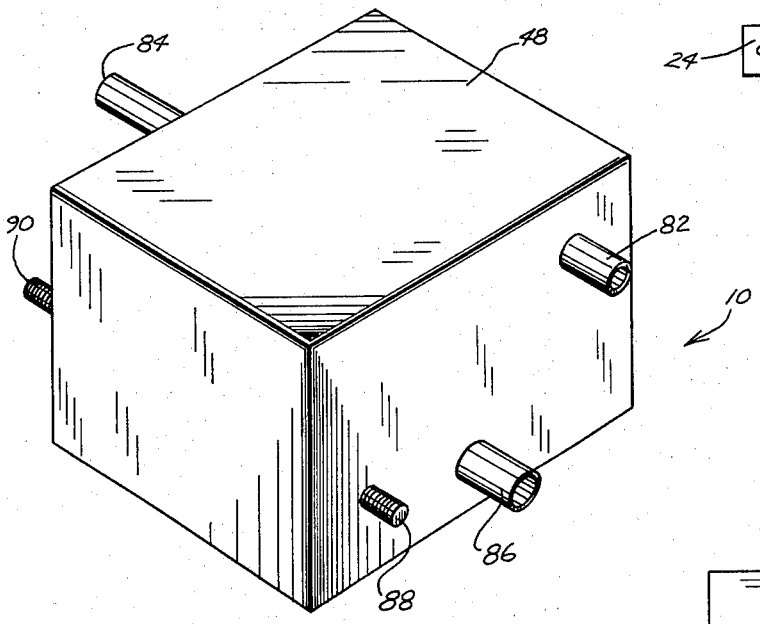
FIG. 1 is a perspective view illustrating the electrolyzer unit of this invention.

Referring now to the drawings wherein like reference numerals designated identical or corresponding parts throughout the several views, FIG. 1 illustrates the electrolyzer unit 10 of the present invention.

Generally, the electrolyzer unit 10 includes a plurality of electrodes 12 (FIGS. 2, 5, 7 and 8, 11), microporous dividers 14 positioned between the electrodes 12 with gas plates 16 positioned on the top of the electrodes and electrolyte plates 18 positioned on the bottom with oxygen end plates 20 on one end of the unit 10 and a hydrogen end plates 22 on the opposite end of the unit 10.

Figure 2:
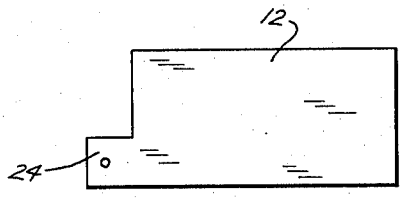
FIG. 2 is a side view of an electrode utilized in the present invention.
Figure 3:
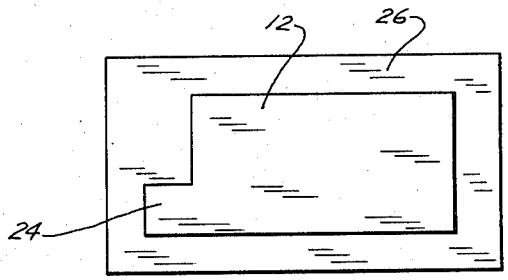
FIG. 3 is a side view of an electrode frame.
Figure 4:
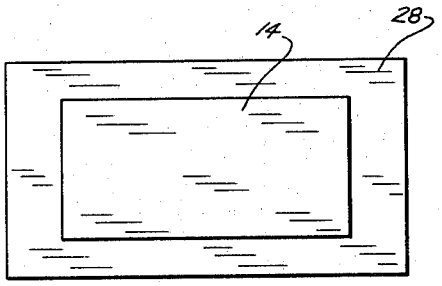
FIG. 4 is a side view of the electrode retaining frame.
Figure 5:
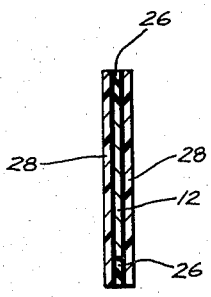
FIG. 5 is an end view of the electrode assembly.
Figure 7:
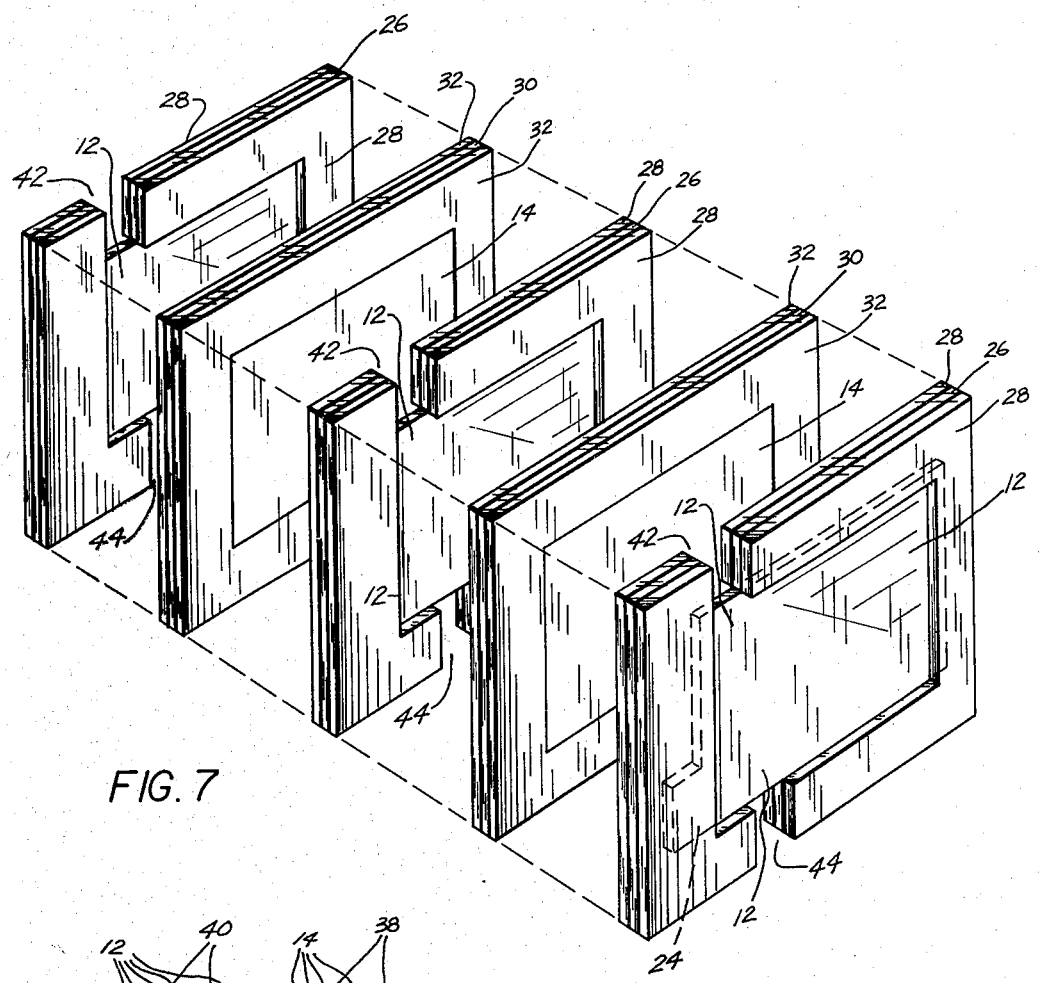
FIG. 7 is a perspective exploded view of a cell.

Specifically the electrodes 12 as illustrated in FIG. 2 are made from sintered nickel. The sintered nickel provides a large exposed surface area compared with relatively small physical dimensions for the electrode 12. An electrode is generally rectangular shape with a electrode tab 24 extending out from the electrode 12 onto which an electrical connection to a source of energy may be made. The electrode 12 is placed in an electrode frame 26 (FIG. 3) with electrode retaining frames 28 (FIG. 4) spaced on both sides of the electrode frame 26 housing the electrode 12 (FIG. 5).

Figure 6:
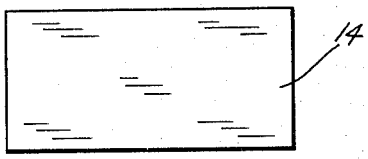
FIG. 6 is a side view of the micro-porous divider.

The micro-porous divider 14 (FIG. 6) is constructed of porous material which will allow flow of electrical charge therethrough while still prohibiting gasses such as hydrogen and oxygen from passing through. The supporting structure (FIG. 7) of the micro-porous divider 14 is similar to that previously described for the electrodes 12 and includes a micro-porous divider frame 30 with micro-porous divider retaining frames 32 on both sides of the micro-porous divider frame 30.

Figure 8:
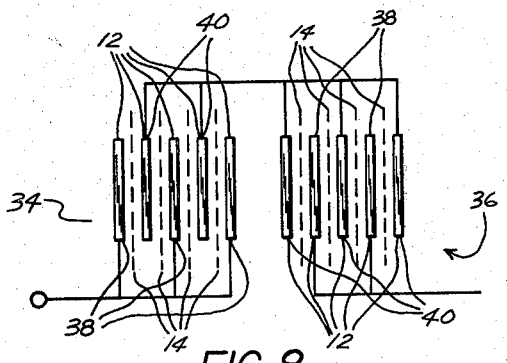
FIG. 8 is a schematic diagram illustrating the electrical connection to the electrodes of two cells.

In constructing the electrode assembly (FIG. 7) an electrode 12 in its frame 26 and retaining frames 28 is placed on each side of the micro-porous divider assembly which includes the micro-porous divider 14, its frame 30 and retaining frames 32. The electrodes 12 are arranged with the electrode tabs 24 of adjacent electrodes 12 opposite each other relative to the longitudinal axis of the electrode 12 so as to provide all negative electrode tabs 24 on one side of the unit and all positive electrode tabs 24 tabs 24 on the opposite side of the unit 10. The electrolyzer unit 10 is comprised of a plurality of electrodes 12 as illustrated in the schematic representation of FIG. 8. The number of electrodes 12 utilized is in part dependent upon the electrical energy available, with the general parameters providing one ampere of current per square inch of electrode surface area and approximately 2.4 volts per cell. In FIG. 8 two cells 34 and 36 respectively are illustrated with cell 34 comprised of three negative electrodes 38 and two positive electrodes 40 with each of the negative and positive electrodes 38 and 40 separated by a micro-porous divider 14. The second cell 36 is comprised of three negative electrodes 40 and two positive electrodes 38 with micro-porous dividers 14 separating the negative and positive electrodes 38 and 40. The cells 34 and 36 are electrically connected in series and in a typical embodiment several more cells would be added after cell 36, all connected in series. Further a cell divider 33 (not illustrated) isolates one cell from the next and prevents intermixing of electrolyte between adjacent cells.

Gas vents 42 on the top of the unit 10 and electrolyte vents 44 on the bottom of the unit 10 (FIG. 7) extend through each of the electrode frames 26 and retaining frames 28 with all of the vents 42 and 44 in each cell for each polarity of electrode in alignment with each other for the respective polarity along the top and bottom of the frame 26 and retaining frame 28 and running perpendicular to the longitudinal axis of the electrodes 12.

Figure 9:
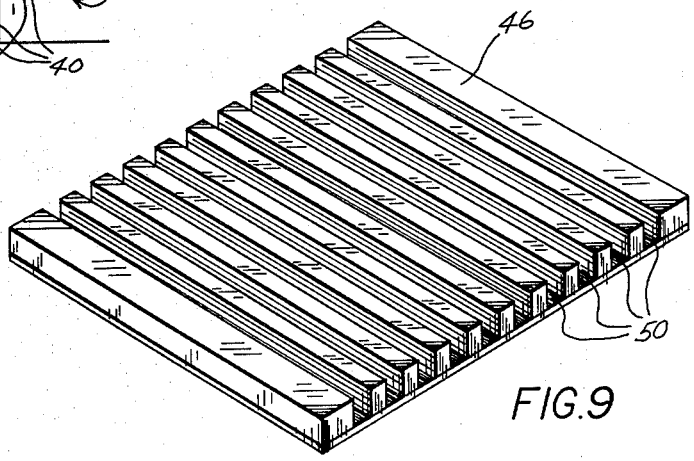
FIG. 9 is a perspective view of the first gas plate.
Figure 10:
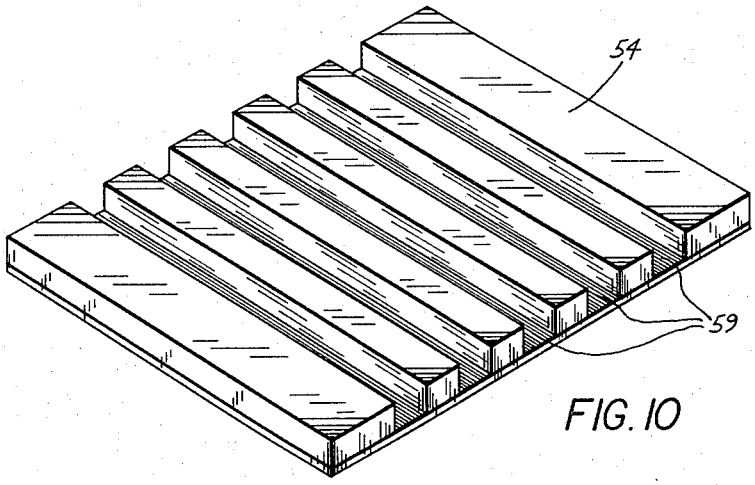
FIG. 10 is a perspective view of the first electrolytic plate.

Gas plates 16 (FIGS. 9, 10 and 11) include a first plate 46 and a second plate 48 with gas ducts 50 cut into the plates 46 and 48. The first plate 46 is positioned on the top of the assembled electrodes 12, the gas ducts 50 facing upward with a divider plate 52 laid over the plate 46 and the second plate 48 inverted relative to the first plate 46 and placed on the divider plate 52 and aligned so that the gas ducts 50 on both plates 46 and 48 are aligned with each other.

Figure 11:
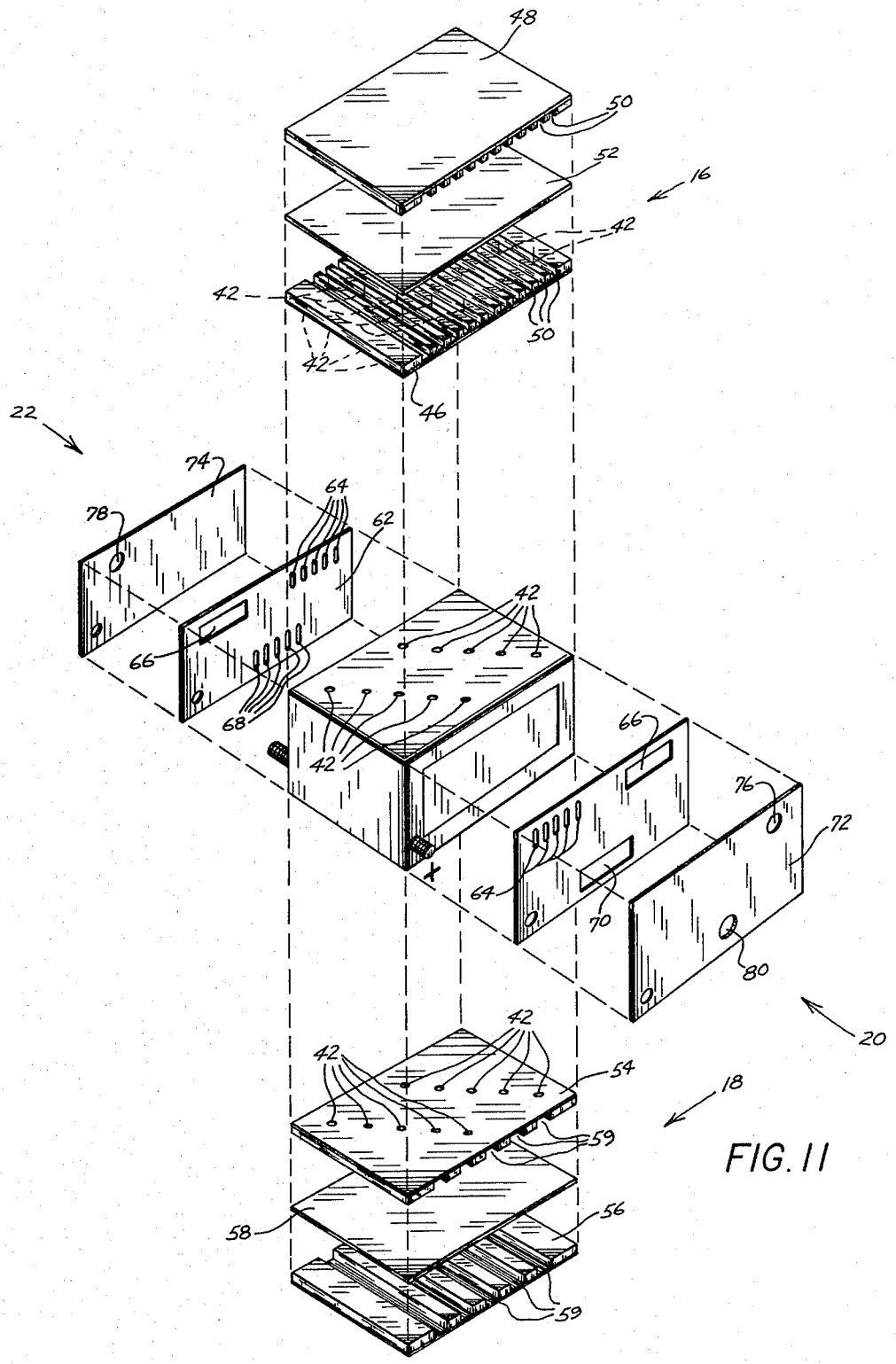
FIG. 11 is a perspective exploded view of the gas and electrolyte plates and the oxygen and hydrogen collecting and cover plates.

The electrolyte plates 18 are similar in construction and function to the gas plates 16 and include a first electrolyte plate 54 and second electrolyte plate 56 with a divider plate 58 and electrolyte ducts 59 cut into plate 54 and 56, all positioned on the bottom of the assembled electrodes and assembled as the gas plates 16. The spacing and dimensions of the ducts 50 and 59 are aligned to provide at least one gas vent 42 per gas duct 50 and in some instances many more where a cell is comperised of several electrodes, and at least one electrolyte vent 42 per electrolyte duct 59 with the apertures extending through the first plate 46 and the first electrolyte plate 54. As illustrated in FIG. 11, the spacing between gas ducts 50 is one-half that of electrolyte ducts 59, since there are twice as many ducts 50 as ducts 59.

Figure 12:
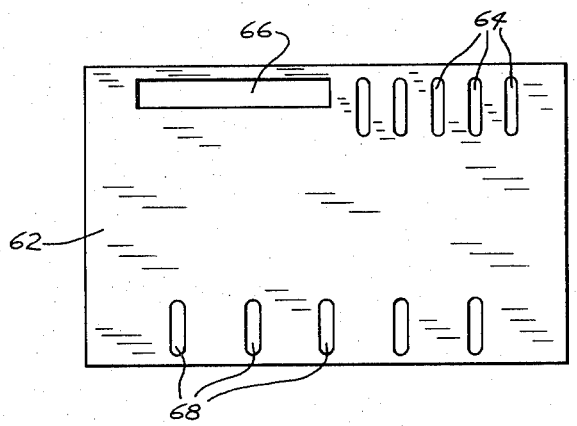
FIG. 12 is a side view of the hydrogen collection plate.
Figure 13:
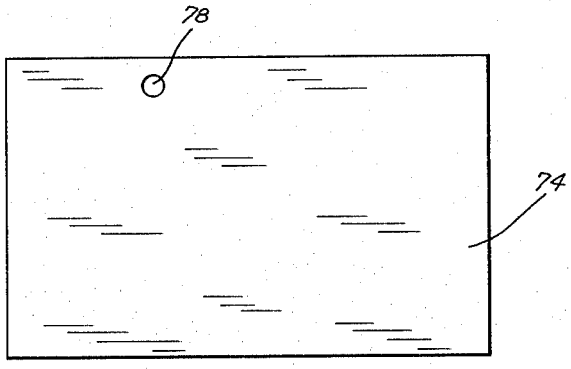
FIG. 13 is a side view of the hydrogen cover plate.

Oxygen end plates 20 and hydrogen end plates 22 (FIGS. 11, 12 and 13) are positioned on opposite ends of the unit 10 and include oxygen and hydrogen collecting plates 60 and 62. Illustrated in FIG. 12 is the hydrogen collecting plate 62. The collecting plates 60 and 62 include gas channel guides 64 which allow the gas to pass from the bottom to the top of the duct 50. The collecting plates 60 and 62 also include gas collecting channels 66 which gathers the gas as it exits the top of the duct 50 while still keeping the gas separate. The channel guides 64 and collecting channels 66 as illustrated in FIG. 12 are located on the collecting plate 64 for hydrogen gas with the guides 64 and channels 66 for the oxygen collecting plate 60 (FIG. 12) on opposite sides of the plate 64 to match up with the correct ducts 50 carrying the oxygen gas. The hydrogen collecting plate 62 further includes electrolyte channel guides 68 which permits the electrolyte to flow from the botton to upper electrolyte duct 59. The oxygen directing plate 60 also includes an electrolyte collecting channel 70 which gathers the electrolyte after passing through the electrolyte duct 59. Oxygen and hydrogen cover plates 72 and 74 overlap the oxygen and hydrogen collecting plates 60 and 62 respectively and include oxygen and hydrogen gas vents 76 and 78 through which the gas passes from the collecting channels 66. The oxygen cover plate also includes an electrolyte passage 80 through which the electrolyte passes to the inside of the unit 10. As illustrated in FIG. 1 oxygen and hydrogen gas outlets 82 and 84 may extend the passages 76 and 78 and electrolyte connector 86 may extend the electrolyte passage 80. The gas plates 16 which include plates 46 and 48 with ducts 50 and divider plate 52 and the end plates 20 and 22 which include the collecting plates 60 and 62 with the gas channeling guides 64 and the cover plates 72 and 73 all form the gas channeling 75.

The electrolyte plates 18 which include plates 54 and 56 with ducts 59 and divider plate 58 and the end plates 20 and 22 which include the collecting plates 60 and 62 with electrolyte channel guides 68 in the hydrogen collecting plate 62 and the cover plate 73 all form the electrolyte channeling 77.

Positive and negative terminals 88 and 90 (FIG. 1) extend through the unit 10 and make electrical contact with the electrode tabs 24 of the proper positive and negative electrodes 12.

During operation of the unit 10, the gas evolved off the electrodes 12 pass through the gas duct 50 as well as with the electrolyte that has passed by the electrodes. The electrolyte absorbs the heat from the electrodes 12 and carries the heat out of the unit 10. The electrolyte can be gathered externally, cooled if necessary and then recycled through the unit 10. The gas duct 50 creates a long path through the unit 10 and as a result the electrical path available between cells within the unit 10 has such a high resistance that shunt currents between the individual cells is significantly reduced to the point that short circuiting between cells is not a problem. As is readily apparent from the description, the design and construction of the unit 10 allows both sides of the electrodes 12 to be utilized on a majority of the electrodes 12. This increases the efficiency of the unit 10 in terms of gas production per electrode while reducing the total number of electrodes needed.

All components of the unit 10 with the exception of the electrodes 12, micro-porous dividers 14 and terminals 86 and 87 may be constructed of plastic material or other like material which is inert to the electrolyte, heat and gasses generated as well as being easily joined together. The micro-porous dividers 14 may be constructed of polyvinyl chloride material which is suitable for the intended use.

The electrolyte used is in part dependent on the composition of the electrodes as the type of gas to be generated. In the present invention, hydrogen is generated and the electrolyte in a 30% solution of potassium hydroxide.

Obviously many modifications and variations of the present invention are possible in light of the above teachings. It is therefore to be understood that, within the scope of the appended claims, the invention may be practiced otherwise than as specifically described.

I claim:

1. An electrolyzer for the generation of gas, comprising:

a plurality of cells, said cells forming a group and being arranged parallel and adjacent to each other and each of the cells electrically connected in series and to a source of electrical energy and utilizing a common electrolyte;

said cells including at least two electrodes and a micro-porous divider, said electrodes being spaced parallel to each other and constructed of sintered nickel with the micro-porous divider positioned between each pair of electrodes and permitting the flow of electrical charge therethrough;

electrolyte channeling means for carrying electrolyte to each of the cells including a first and second plate with a divider plate therebetween, all positioned on the bottom of the cells, electrolyte end plate means, said end plate means positioned on each end of the group of cells for directing the flow of electrolyte from the first plate to the second plate of said electrolyte channeling means; and gas channeling means for carrying gas out of the cells including first and second plates with a divider plate therebetween all positioned on the top of the cells, gas end plate means, said gas end plate means positioned on each end of the group of cells for directing the flow of gas from the first plate to the second plate of said gas channeling means.

2. An electrolyzer as defined in claim 1 wherein the first and second plates include electrolyte ducts through which electrolyte may pass.

3. An electrolyzer as defined in claim 1 wherein the first and second plates include gas ducts through which gas and electrolyte may pass.

4. An electrolyzer as defined in claim 1 wherein the electrolyte end plate means include an electrolyte channel guide with a cover plate overlaying said electrolyte channel guide.

5. An electrolyzer as defined in claim 4 wherein the gas end plate means include a gas channel guide with a cover plate overlying said gas channel guide.

6. An electrolyzer as claimed in claim 5 further including electrode frames and electrode retaining frames, the electrode being mounted onto the electrode frame, and the electrode retaining frames being positioned on both sides of the electrode frame.

7. An electrolyzer as claimed in claim 6 further includes gas vents, said gas vents extending through the top of the electrode frame and electrode retaining frame and in contact with said electrode, through which gas and electrolyte may pass.

8. An electrolyzer as claimed in claim 7 wherein the gas vents in each cell are parallel to each other along the longitudinal axis of the electrolyzer.

9. An electrolyzer as claimed in claim 6 further including electrolyte vents, said vents extending through the first electrolytic plate, the electrode frame and electrode retaining frame and contacting said electrode, through which the electrolyte may pass.

10. An electrolyzer as claimed in claim 9 wherein the electrolyte vents in each cell are parallel to each other along the longitudinal axis of the electrolyzer.

11. An electrolyzer as claimed in claim 5 further including a micro-porous divider frame and a micro-porous divider retainer frame, the micro-porous divider being mounted onto said micro-porous divider frame, and the micro-porous divider retaining frames being positioned on both sides of the micro-porous divider frame.

12. An electrolyzer for the generation of gas, comprising:

a plurality of cells, said cells forming a group and being arranged parallel and adjacent to each other and each of the cells electrically connected in series and to a source of electrical energy and utilizing a common electrolyte;

each of said cells including at least two electrodes and a micro-porous divider, said electrode being spaced parallel to each other and constructed of sintered nickel with the micro-porous divider positioned between each pair of electrodes and permitting the flow of electrical charge therethrough, electrode frames and electrode retaining frames, the electrodes being mounted onto said electrode frames, and said electrode retaining frames being positioned on both sides of the electrode frame, a micro-porous divider frame and a micro-porous divider retainer frame, the micro-porous divider being mounted onto said micro-porous divider frame and said micro-porous divider retaining frame being positioned on both sides of the micro-porous divider frame;

electrolyte channeling means for carrying electrolyte to each of the cells including first and second plates with a divider plate therebetween, all positioned on the bottom of the cells, the first and second plates including electrolyte ducts through which electrolyte may flow, electrolyte end plate means positioned in each end of the group of cells for directing the flow of electrolyte from the first plate to the second plate of the electrolyte channeling means and including electrolyte channel guide with a cover plate overlaying said electrolyte channel guide;

gas channeling means for carrying gas out of the cells including first and second plates with a divider plate therebetween all positioned on the top of the cells, the first and second plates include gas ducts through which the gas may pass, gas end plate means positioned on each end of the group of cells for directing the flow of gas from the first plate to the second plate of said gas channeling means and including gas channel guides with a cover plate overlaying said gas channel guide.

13. An electrolyzer as defined in claim 12 further including gas vents and electrolyte vents, said gas vents extending through the top of the electrode frame and electrode retaining frame and in contact with said electrode, through which gas may pass, said electrolyte vents extending through the first electrolyte plate, the electrode frame and electrode retaining frame and contacting said electrode through which the electrolyte may pass.

14. An electrolyzer as claimed in claim 13 wherein said gas and electrolyte vents in each cell are parallel to each other along the longitudinal axis of the electrolyzer.

* * * * *